US008807557B2

(12) United States Patent
Lu et al.

(10) Patent No.: US 8,807,557 B2
(45) Date of Patent: Aug. 19, 2014

(54) MEDIA SIZE DETECTION DEVICE AND METHOD

(71) Applicant: Hon Hai Precision Industry Co., Ltd., New Taipei (TW)

(72) Inventors: Shu-Kai Lu, New Taipei (TW); Kai Fan Chiang, New Taipei (TW); Chin-Ta Ma, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/899,749

(22) Filed: May 22, 2013

(65) Prior Publication Data

US 2014/0001701 A1 Jan. 2, 2014

(30) Foreign Application Priority Data

Jul. 2, 2012 (TW) ..... 101123801 A

(51) Int. Cl.

| | |
|---|---|
| ***B65H 1/00*** | (2006.01) |
| ***B65H 1/04*** | (2006.01) |
| ***B65H 1/26*** | (2006.01) |

(52) U.S. Cl.

CPC ..... *B65H 1/04* (2013.01); *B65H 1/266* (2013.01); *B65H 2511/10* (2013.01); *B65H 2511/11* (2013.01); *B65H 2511/12* (2013.01)

USPC ..... 271/171

(58) Field of Classification Search

CPC ..... B65H 1/04; B65H 2511/10; B65H 1/266; B65H 2511/12; B65H 2301/141; B65H 2511/11

USPC ..... 271/171

See application file for complete search history.

(56) References Cited

U.S. PATENT DOCUMENTS

| | | | | |
|---|---|---|---|---|
| 2005/0133983 | A1* | 6/2005 | Jacobs et al. | 271/145 |
| 2013/0270765 | A1* | 10/2013 | Araaki et al. | 271/171 |

* cited by examiner

*Primary Examiner* — David H Bollinger

(74) *Attorney, Agent, or Firm* — Novak Druce Connolly Bove + Quigg LLP

(57) ABSTRACT

A media size detection device for detecting a size of a media held in a media tray is provided. The device includes a width adjuster and a length adjuster, a first magnetic member indicates width and a second magnetic member indicates length, and a plurality of magnetic sensors arranged on a lower surface of the media tray generates signals as to respective proximities of the first and second magnetic members, the act of placing and securing the media within the media tray enables the automatic calculation of the size of the media. A media size detection method is also provided.

12 Claims, 8 Drawing Sheets

| Media Size | The First Magnetic Sensor | The Second Magnetic Sensor | The Third Magnetic Sensor | The Fourth Magnetic Sensor |
|---|---|---|---|---|
| A4/Letter | 0 | 1 | 0 | 0 |
| Legal | 0 | 1 | 0 | 1 |
| A3/B Size | 1 | 0 | 1 | 0 |
| Landscape A4 | 1 | 0 | 0 | 0 |

FIG. 7

MEDIA SIZE DETECTION DEVICE AND METHOD

REFERENCE TO RELATED APPLICATIONS

This application claims all benefits accruing under 35 U.S.C. §119 from Taiwan Patent Application No. 101123801, filed on Jul. 2, 2012 in the Taiwan Intellectual Property Office, the contents of the Taiwan Application are hereby incorporated by reference.

BACKGROUND

1. Technical Field

The present disclosure relates to media size detection devices and methods for detecting a size of a media in an image formation device.

2. Description of Related Art

Image formation devices, such as printers, often include adjustable media trays to accommodate media of different sizes. In these types of image formation devices, when a user places a media in the media tray, it is necessary for the user to select a correct size of the media via a user interface (UI) on the image formation devices. However, it may be difficult for the user to correctly determine the size of the media held in the media tray.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

FIG. 7 is an example of a size mapping table in accordance with an embodiment.

DETAILED DESCRIPTION

Figure 1:
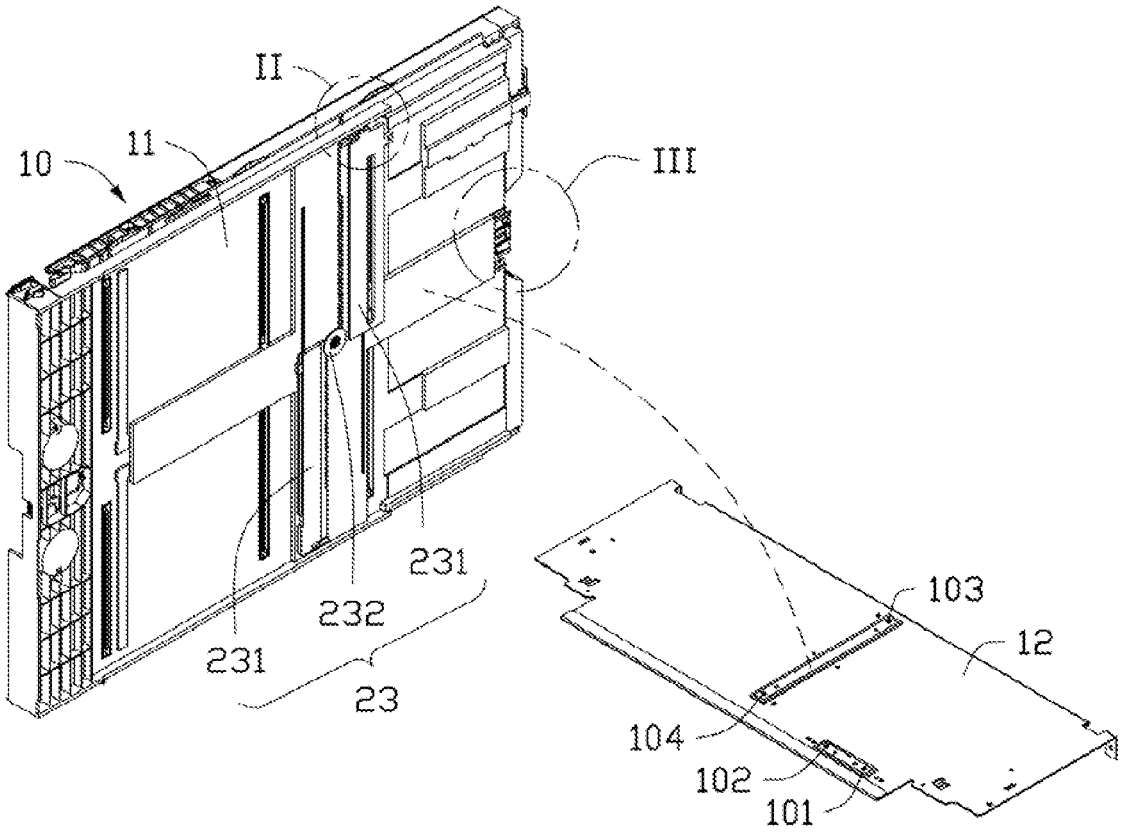
FIG. 1 is an exploded, isometric view of a media size detection device in accordance with an embodiment.
Figure 2:
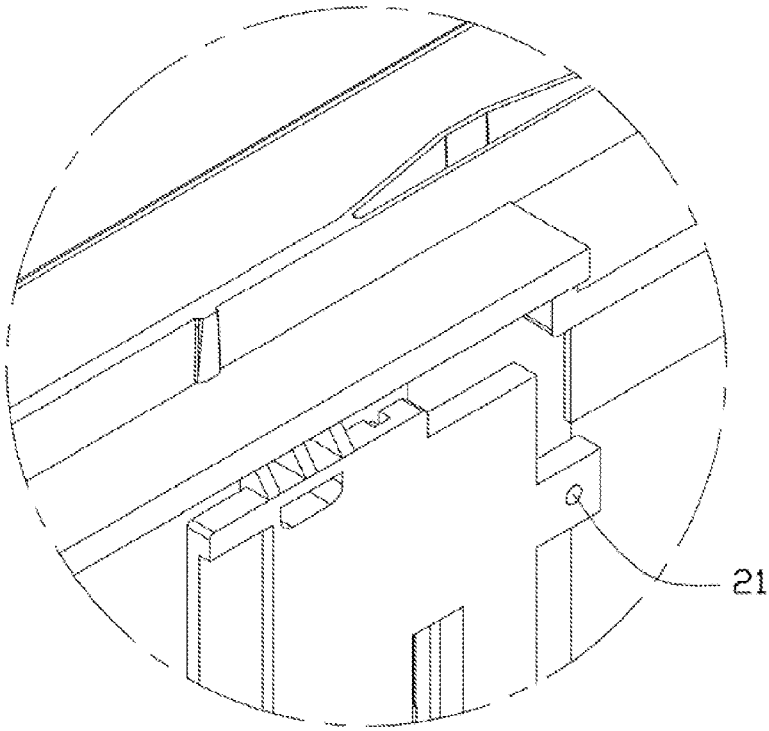
FIG. 2 is an enlarged view of circled part II of the FIG. 1.
Figure 3:
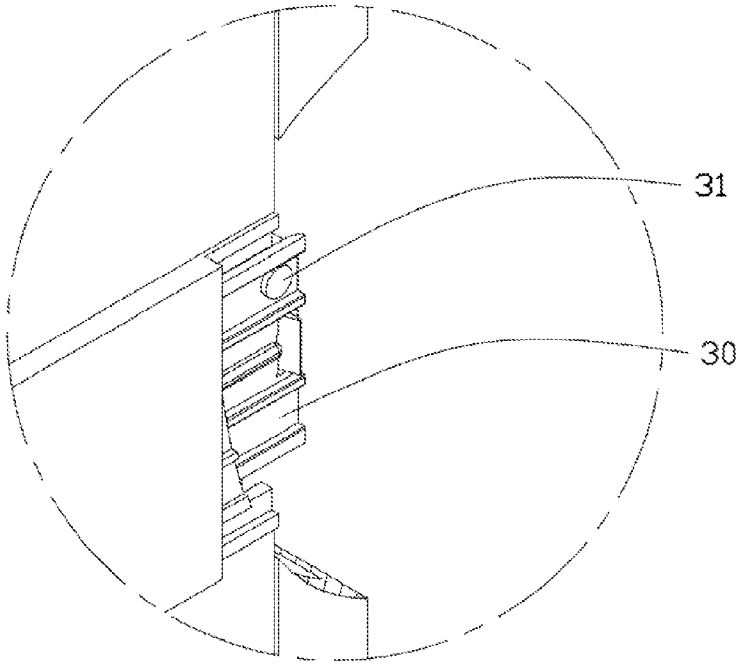
FIG. 3 is an enlarged view of circled part III of the FIG. 1.
Figure 4:
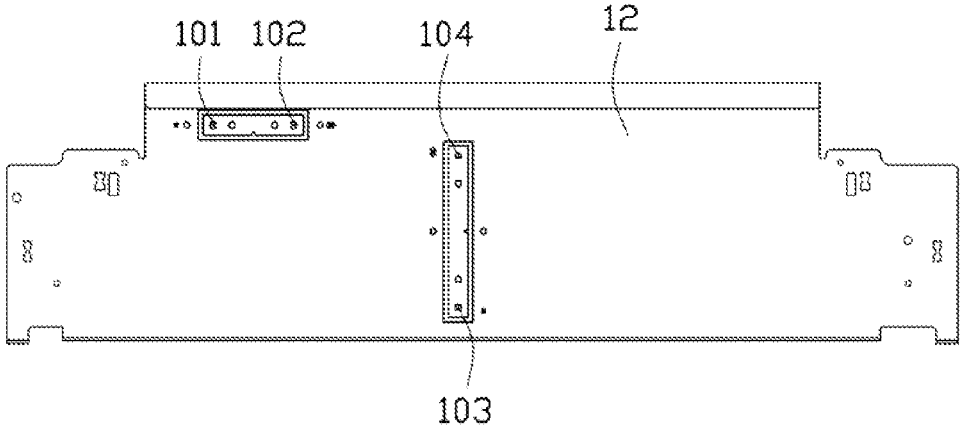
FIG. 4 is a top view of a mounting plate of the media size detection device of FIG. 1.
Figure 5:
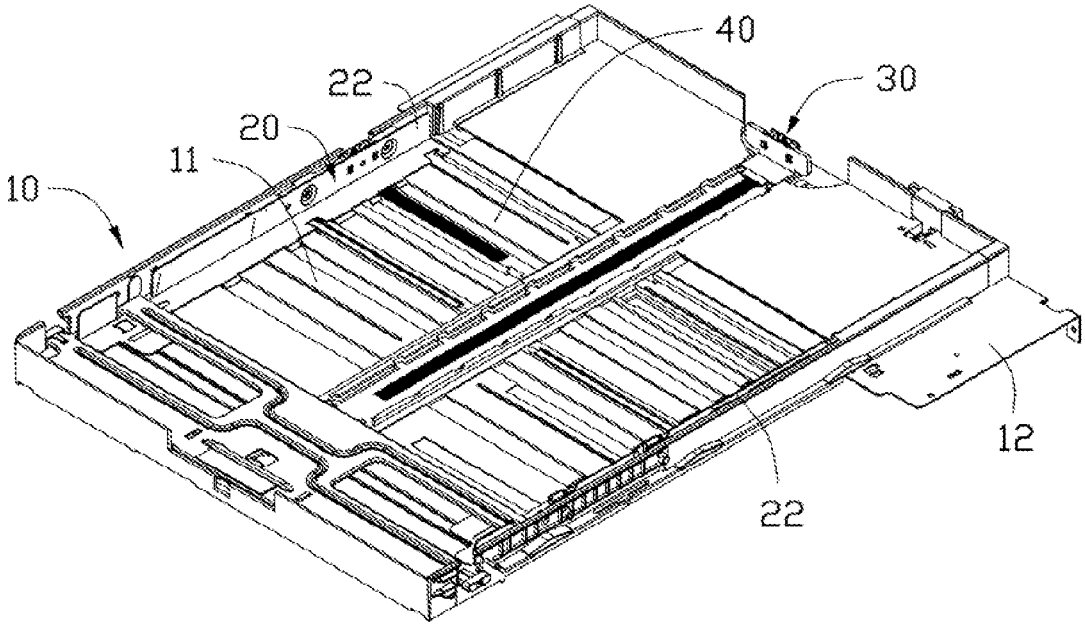
FIG. 5 is an assembled view of the media size detection device of FIG. 1.
Figure 6:
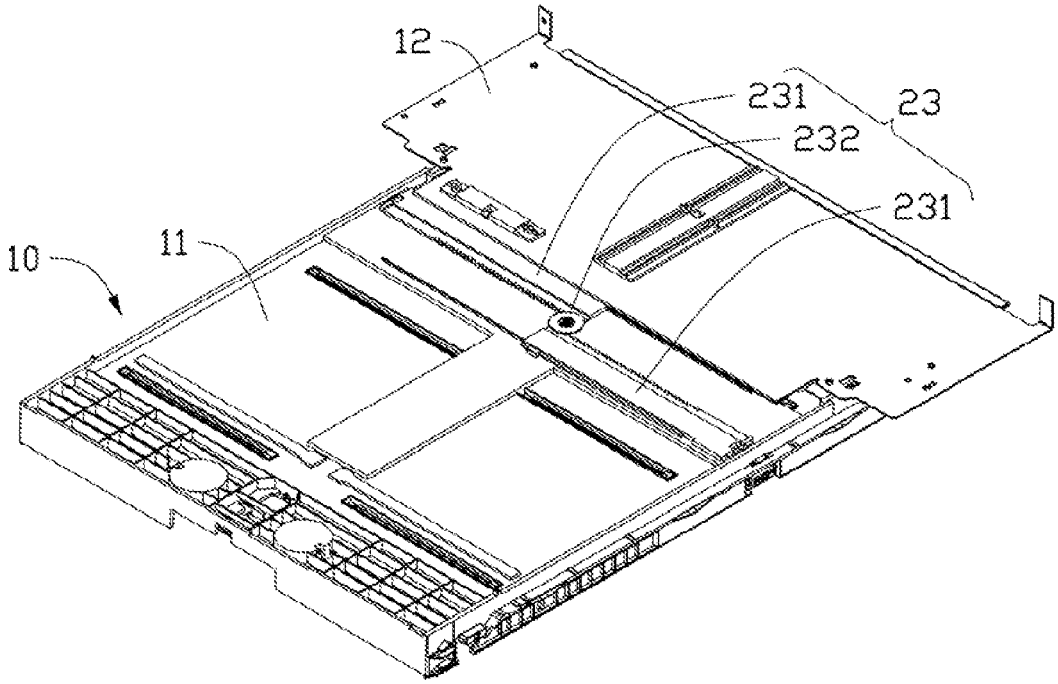
FIG. 6 is similar to FIG. 5, but viewed from a different aspect.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

FIGS. 1-6 show a media size detection device in accordance with an embodiment. The media size detection device includes a media tray 10, a width adjuster 20, and a length adjuster 30. The media tray 10 includes a bottom plate 11. The width adjuster 20 and the length adjuster 30 are located on an upper surface of the bottom plate 11.

The width adjuster 20 is movable in accordance with a widthwise dimension of the bottom plate 11. The length adjuster 30 is movable in accordance with a lengthwise dimension of the bottom plate 11. The bottom plate 11 together with the width adjuster 20 and the length adjuster 30 defines a media placing area for the placing of a media, such as a sheet of paper. The media tray 10 can support a range of media sizes by way of moving the width adjuster 20 and the length adjuster 30 to a variety of positions.

The width adjuster 20 includes two limiting plates 22 and a linking member 23. The two limiting plates 22 are parallel to each other and perpendicular to the bottom plate 11 of the media tray 10. The linking member 23 interconnects the two limiting plates 22. The distance between the two limiting plates 22 determines the width of the media placing area in the media tray 10.

The linking member 23 is located on a lower surface of the bottom plate 11 of the media tray 10. The linking member 23 includes two toothed racks 231 and a gear 232 meshed with the two toothed racks 231. Each of the two toothed racks 231 is connected to one of the two limiting plates 22. The linking member 23 facilitates the movement of the two limiting plates 22 towards or away from each other.

The media size detection device further includes a first magnetic member 21 and a second magnetic member 31. The first magnetic member 21 is attached to the width adjuster 20 and can move together with the width adjuster 20. The second magnetic member 31 is attached to the length width adjuster 30 and can move together with the length width adjuster 30.

The media size detection device further includes a first magnetic sensor 101, a second magnetic sensor 102, a third magnetic sensor 103, and a fourth magnetic sensor 104.

The first magnetic sensor 101, the second magnetic sensor 102, the third magnetic sensor 103, and the fourth magnetic sensor 104 are mounted to a mounting plate 12. The mounting plate 12 is attached to a lower surface of the bottom plate 11 of the media tray 10. The first magnetic sensor 101, the second magnetic sensor 102, the third magnetic sensor 103, and the fourth magnetic sensor 104 are sandwiched between the mounting plate 12 and the bottom plate 11 of the media tray 10. In one embodiment, each of the first magnetic sensor 101, the second magnetic sensor 102, the third magnetic sensor 103, and the fourth magnetic sensor 104 includes a Hall effect sensor.

The first magnetic sensor 101 and the second magnetic sensor 102 are arranged in a first line in accordance with the widthwise dimension of the bottom plate 11 and adapted to sense the proximity of the first magnetic member 21. The third magnetic sensor 103 and the fourth magnetic sensor 104 are arranged in a second line in accordance with the lengthwise dimension of the bottom plate 11 and adapted to sense the proximity of the second magnetic member 31. Each of the first magnetic sensor 101, the second magnetic sensor 102, the third magnetic sensor 103, and the fourth magnetic sensor 104 is adapted to generate a position signal to indicate whether it senses any of the first magnetic member 21 and the second magnetic member 31 or not. For example, when the first magnetic sensor 101 senses the first magnetic member 21, the first magnetic sensor 101 generate a position signal with a high electrical level to indicate that the first magnetic 21 and the width adjuster 20 are above or close to being above the first magnetic sensor 101. In contrast, when the first magnetic sensor 101 does not sense the first magnetic member 21, the first magnetic sensor 101 generates a position signal with a low electrical level to indicate that the first magnetic 21 and the width adjuster 20 are not yet above or close to being above the first magnetic sensor 101. Thus, when the width adjuster 20 and the length adjuster 30 are moved to different positions, the first magnetic sensor 101, the second magnetic sensor 102, the third magnetic sensor 103, and the fourth magnetic sensor 104 may generate different combinations of position signals.

Referring to FIG. 7, an example of a size mapping table in accordance with an embodiment is shown. The size mapping table includes relationships between combinations of the position signals and predetermined media sizes. In the size mapping table, an integer 1 represents a position signal with a high electrical level, and an integer zero represents a position signal with a low electrical level. For example, when the position signal generated by the first magnetic sensor 101 is 1 and the other three position signals generated by the second magnetic sensor 102, the third magnetic sensor 103, and the fourth magnetic sensor 104 are all zero, the media size is determined to be A4 size. When the signals generated by the second magnetic sensor 102 and by the fourth magnetic sensor 104 are both 1 and the other two position signals generated by the first magnetic sensor 101 and the third magnetic sensor 103 are zero, the media size is determined to be Legal size.

The media size detection device further includes a logic unit (not shown). The logic unit compares the respective signals generated by all the magnetic sensors 101-104 with the size mapping table and determines the size of the media. The logic unit can be embodied in either hardware or software.

Figure 8:
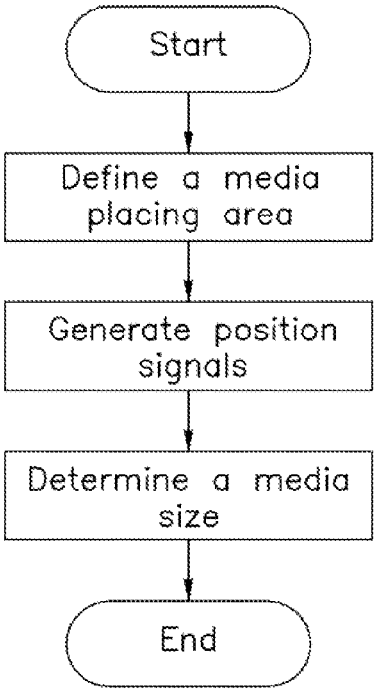
FIG. 8 is a flowchart of a media size detection method in accordance with an embodiment.

Referring to FIG. 8, a flowchart of a media size detection method is illustrated. The method comprises the following steps.

In step S802, the bottom plate 11 together with the width adjuster 20 and the length adjuster 30 defines a media placing area for the placing of a media to receive a hard copy, such as a sheet of paper.

In step S804, the first magnetic sensor 101, the second magnetic sensor 102, the third magnetic sensor 103, and the fourth magnetic sensor 104 generates four position signals to indicate whether they senses any of the first magnetic member 21 and the second magnetic member 31 or not.

In step S806, the logic unit compares the four position signals generated by the first magnetic sensor 101, the second magnetic sensor 102, the third magnetic sensor 103, and the fourth magnetic sensor 104 with the size mapping table and thus determines the size of the media.

It is to be understood however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

In particular, depending on the embodiment, certain steps or methods described may be removed, others may be added, and the sequence of steps may be altered. The description and the claims drawn for or in relation to a method may give some indication in reference to certain steps. However, any indication given is only to be viewed for identification purposes, and is not necessarily a suggestion as to an order for the steps.

What is claimed is:

1. A media size detection device for detecting a size of a media, comprising:

a media tray comprising a bottom plate;

a width adjuster and a length adjuster located on an upper surface of the bottom plate, the width adjuster being movable in accordance with a widthwise dimension of the bottom plate, the length adjuster being movable in accordance with a lengthwise dimension of the bottom plate, wherein the bottom plate together with the width adjuster and the length adjuster defines a media placing area for placing the media;

a first magnetic member attached to the width adjuster;

a second magnetic member attached to the length width adjuster;

a plurality of magnetic sensors arranged on a lower surface of the bottom plate and adapted to generate a plurality of position signals, wherein each of the plurality of position signals is adapted to indicate whether one of the plurality of magnetic sensors detects any of the first magnetic member and the second magnetic member or not; and a logic unit adapted to determine the size of the media according to the plurality of position signals generated by the plurality of magnetic sensors;

wherein the plurality of magnetic sensors comprises a first magnetic sensor, a second magnetic sensor, a third magnetic sensor, and a fourth magnetic sensor, the first magnetic sensor and the second magnetic sensor are arranged in a first line in accordance with the widthwise dimension of the bottom plate and adapted to sense the first magnetic member, the third magnetic sensor and the fourth magnetic sensor are arranged in a second line in accordance with the lengthwise dimension of the bottom plate and adapted to sense the second magnetic member.

2. The media size detection device of claim 1, wherein the logic unit is further adapted to compare the plurality of position signals with a size mapping table, the size mapping table comprises relationships between combinations of the position signals and predetermined sizes.

3. The media size detection device of claim 1, further comprising a mounting plate attached to the lower surface of the bottom plate of the media tray, wherein the plurality of magnetic sensors is located between and sandwiched by the mounting plate and the bottom plate.

4. The media size detection device of claim 1, wherein the width adjuster further comprises two limiting plates, and a distance between the two limiting plates determines a width of the media placing area in the media tray.

5. The media size detection device of claim 4, wherein the two limiting plates are parallel to each other and perpendicular to the bottom plate of the media tray.

6. The media size detection device of claim 5, wherein the width adjuster further comprises a linking member interconnecting the two limiting plates.

7. The media size detection device of claim 6, wherein the linking member is located on the lower surface of the bottom plate of the media tray.

8. The media size detection device of claim 6, wherein the linking member comprises two toothed racks and a gear meshed with the two toothed racks, each of the two toothed racks is connected to one of the two limiting plates.

9. The media size detection device of claim 1, wherein each of the plurality of magnetic sensors comprises a Hall sensor.

10. A media size detection method for detecting a size of a media, comprising:

defining a media placing area for placing the media in a media tray by a width adjuster and a length adjuster, wherein the width adjuster is movable in accordance with a widthwise dimension of a bottom plate of the media tray, the length adjuster is movable in accordance with a lengthwise dimension of the bottom plate, a first magnetic member is attached to the width adjuster, and a second magnetic member is attached to the length width adjuster;

generating a plurality of positions signals by a plurality of magnetic sensors arranged on a lower surface of the bottom plate, wherein each of the plurality of position signals is adapted to indicate whether one of the plurality of magnetic detects any of the first magnetic member and the second magnetic member or not; and determining the size of the media according to the plurality of position signals generated by the plurality of magnetic sensors;

wherein the step of determining the size of the media comprises comparing the plurality of position signals with a size mapping table, the size mapping table comprises relationships between combinations of the position signals and predetermined sizes.

11. The media size detection method of claim 10, further comprising adjusting a distance of two limiting plates of the width adjuster to determine a width of the media placing area in the media tray.

12. The media size detection method of claim 11, further comprising interconnecting the two limiting plates by a linking member.

* * * * *